United States Patent [19]

Holz

[11] 4,342,993

[45] Aug. 3, 1982

[54] MEMORY DISPLAY PANEL

[75] Inventor: George E. Holz, North Plainfield, N.J.

[73] Assignee: Burroughs Corporation, Detroit, Mich.

[21] Appl. No.: 233,731

[22] Filed: Feb. 12, 1981

Related U.S. Application Data

[63] Continuation of Ser. No. 65,399, Aug. 9, 1979, which is a continuation of Ser. No. 928,996, Jul. 28, 1978.

[51] Int. Cl.[3] ..... G09G 3/28

[52] U.S. Cl. ..... 340/779; 313/217; 315/169.4

[58] Field of Search ..... 340/779; 315/169.4; 313/217

[56] References Cited

U.S. PATENT DOCUMENTS

| | | | |
|---|---|---|---|
| 3,509,408 | 4/1970 | Holz | 315/169.4 X |
| 3,716,742 | 2/1973 | Nakayama et al. | 340/779 X |
| 3,886,404 | 5/1975 | Kurahashi et al. | 340/779 X |
| 3,925,703 | 12/1975 | Schermerhorn | 340/779 X |
| 3,993,921 | 11/1976 | Robinson | 313/217 X |
| 4,060,749 | 11/1977 | Shinada et al. | 313/217 X |
| 4,105,930 | 8/1978 | Coleman | 340/779 X |

*Primary Examiner*—David L. Trafton

*Attorney, Agent, or Firm*—Kevin R. Peterson; Robert A. Green

[57] ABSTRACT

The display panel comprises a gas-filled envelope, made up of a hermetically sealed base plate and face plate, which includes electrodes disposed to form a dot matrix array of cell regions. The array of cell regions includes D. C. cells in which the electrodes are in contact with the gas, and A. C. cells which are insulated from the gas. The electrodes are disposed both on the base plate of the panel and the face plate, and each cell region includes both a D. C. cell and an A. C. cell which cooperate to provide the desired operation.

In operation of the panel, sustaining pulses are applied to the A. C. portion of a cell region, with the potential of the sustaining pulses being insufficient in amplitude to cause glow. The A. C. cells are caused to produce visible glow by first causing the D. C. cells associated therewith to glow, and then the glow of the A. C. cells is sustained by the sustaining pulses.

10 Claims, 3 Drawing Figures

MEMORY DISPLAY PANEL

This is a continuation of application Ser. No. 065,399, filed Aug. 9, 1979 as a Continuation of Ser. No. 928,996, filed July 28, 1978.

BACKGROUND OF THE INVENTION

Flat display panels have been known for many years, and, in general, such panels have been either D.C. panels in which the electrodes are in contact with the gas in the panel, or they have been A.C. panels wherein the panel electrodes have been insulated from the gas by a film of insulating material such as glass. Neither type of panel has had a useful memory characteristic.

SUMMARY OF THE INVENTION

The invention comprises a combination A.C.-D.C. panel which operates with memory.

DESCRIPTION OF THE PREFERRED EMBODIMENTS

Figure 1:
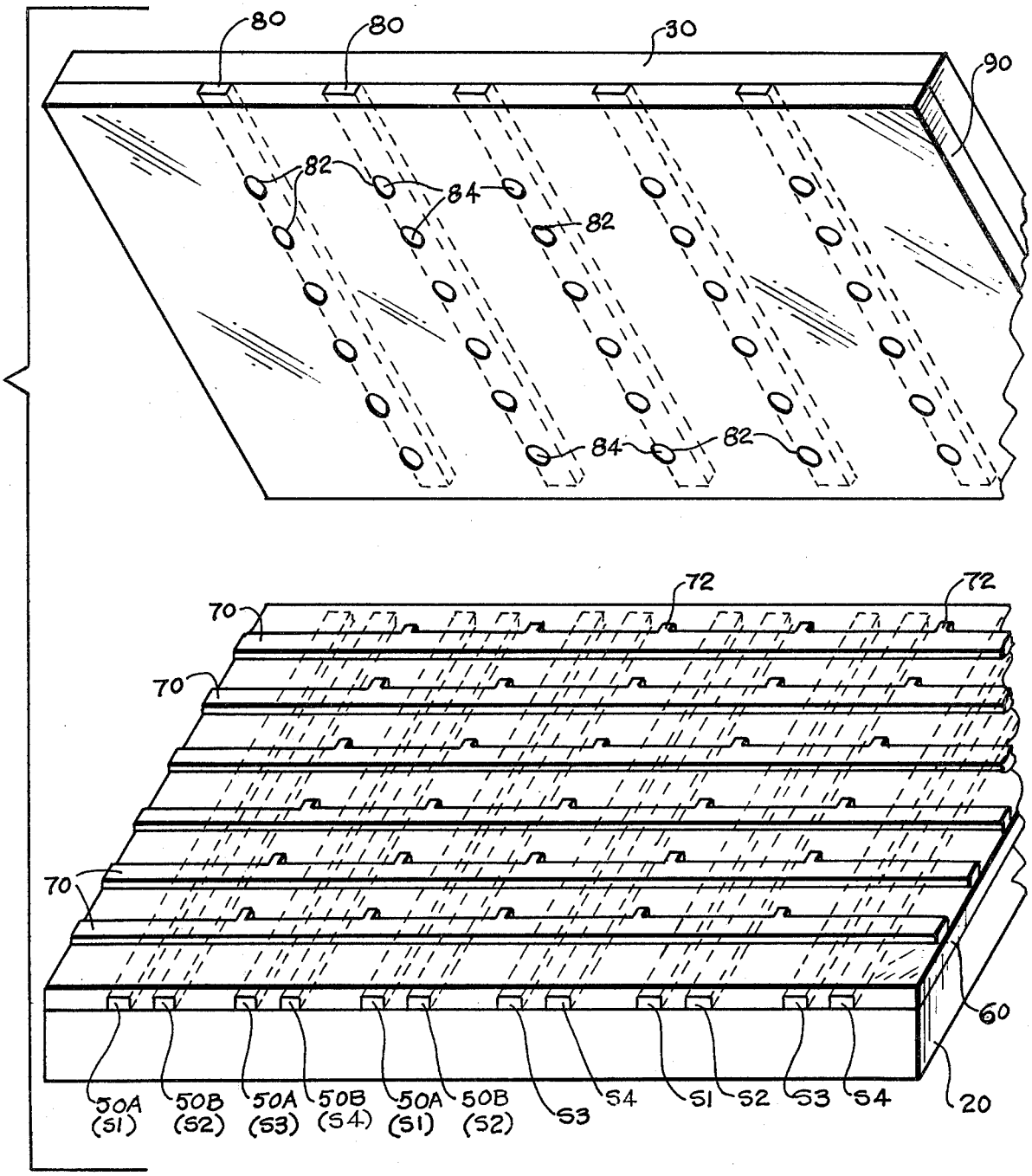
FIG. 1 is a perspective, exploded view of a display panel embodying the invention.
Figure 2:
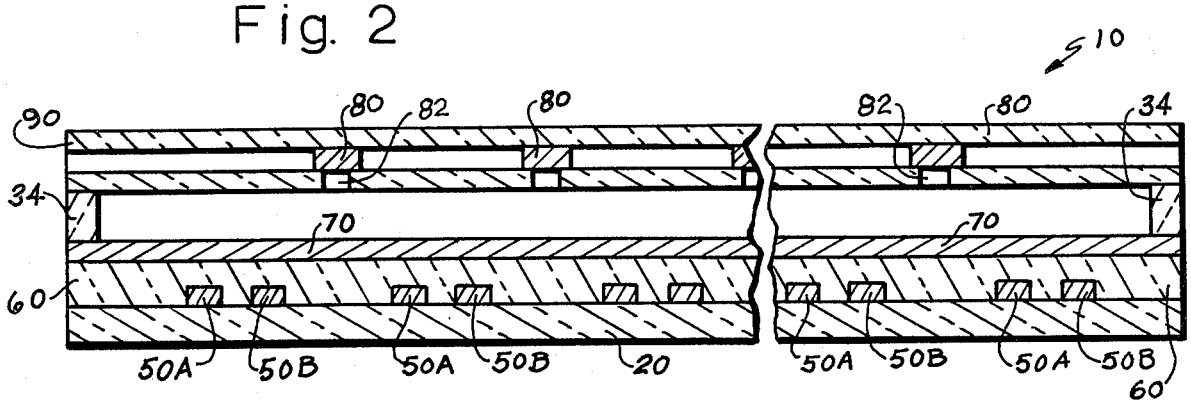
FIG. 2 is a sectional view of the panel of FIG. 1, shown assembled.

The present invention is embodied in a gas-filled display panel 10 which includes a gas-filled envelope made up of a base plate 20 and a face plate 30, both preferably of glass and hermetically sealed together by means of a seal ring 34 with a suitable spacing between them. The base plate 20 includes a top surface 40, on which is formed a plurality of pairs of vertically oriented electrodes 50, each pair including electrodes 50A and 50B. The electrodes of each pair are positioned relatively close together, and adjacent pairs are positioned somewhat farther apart.

A thin layer of insulating material 60 such as glass is formed over the electrode pairs, and a plurality of horizontal electrodes 70 are disposed on the top surface of the insulating layer. The horizontal electrodes are parallel to each other, and they include projections or tabs 72 which are disposed between adjacent pairs of electrodes. The electrode tabs 72 are thus disposed in rows and columns.

The face plate 30 of the panel 10 carries on its inner surface a plurality of parallel vertically oriented electrode strips 80, preferably transparent conductive strips of tin oxide or the like, which are oriented overlying the columns of tabs 72. A thin layer of insulating material 90 is formed over the electrodes 80, with apertures 82 formed therein, each exposing portions 84 of the electrodes 80, each portion 84 overlying a tab 72. The portions 84 of the electrodes 80, thus exposed, combine with the tabs 72 beneath them to form D.C. gas cells.

Figure 3:
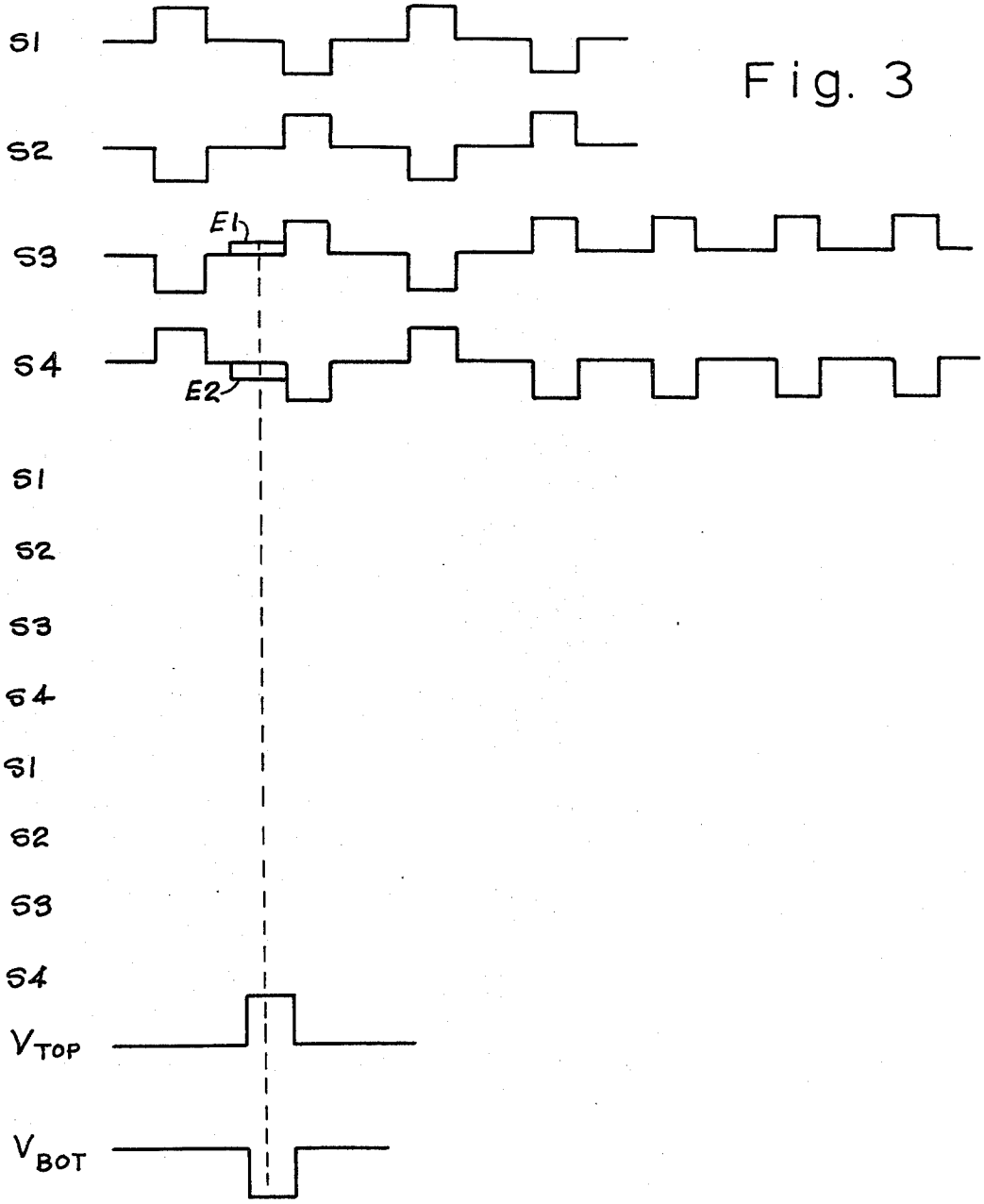
FIG. 3 is a graph showing various operating signals for the panel of FIG. 1.

In one mode of operation of the panel 10, sustaining pulses are applied to all of the A.C. or insulated electrodes 50. For purposes of explanation, these electrodes 50 are numbered S1, S2, S3, S4, S1, S2, S3, S4, beginning at the left and continuing to the right, as seen in FIG. 1. The sustaining pulses shown in FIG. 3 are applied to the electrodes S1, S2, S3, and S4. In order to provide a pattern or message made of glowing cells, the write signals shown as $V_{top}$ and $V_{bot}$ are applied in the time period between the sustaining signals, to the electrodes 80 on the face plate and the tabs 72, which are at the desired locations where glow is required by the message to be displayed. The application of these write signals or pulses will cause cathode glow at the selected cathode tabs 72, and thereafter these applied write pulses can be removed and the glow will be sustained by the applied sustaining signals S1, S2, S3, and S4.

After a message has been written into the panel, the entire message or portions thereof may be erased, by introducing pulses such as those denoted E1 and E2 to the appropriate electrodes S3 and S4. These pulses are of lower amplitude than the sustaining pulses.

Typical pulses applied to electrodes 50A and 50B may be in the range of about 90 to about 220 volts, and the width of these pulses is about 3 to about 15 microseconds. The pulses applied to D.C. electrodes 72 and 80 are about 200 volts. It is noted that current-limiting means should be provided in the drivers which apply D.C. signals to the panel.

What is claimed is:

1. A display panel comprising a gas-filled envelope made up of a base plate and a face plate hermetically sealed together with a space between them and with a gas filling in said space, a plurality of parallel first electrode in said envelope insulated from said gas and adapted to have A.C. signals applied thereto to produce visible glow, and a plurality of second and third electrodes disposed in said envelope in contact with said gas and adapted to produce cathode glow when D.C. operating potentials are applied to selected ones thereof, the cathode glow produced by said selected electrodes facilitating the generation of visible glow between the adjacent ones of said first electrodes having A.C. signals applied thereto.

2. The display panel defined in claim 1 wherein said first electrodes and second electrodes are supported by said base plate, and said second electrodes are operated as cathodes with respect to said third electrodes which are operated as anodes.

3. The panel defined in claim 2 wherein said first electrodes are supported parallel to each other on said base plate and are coated with a layer of insulating material, and said second electrodes are disposed on said insulating layer.

4. The panel defined in claim 2 wherein said first electrodes are supported parallel to each other on said base plate and are coated with a layer of insulating material, and said second electrodes are disposed on said insulating layer parallel to each other and transverse to said first electrodes.

5. The panel defined in claim 2 wherein said first electrodes are provided in pairs and are supported parallel to each other on said base plate and are coated with a layer of insulating material, and said second electrodes are disposed on said insulating layer, said second electrodes having tabs which are disposed between adjacent pairs of said first electrodes.

6. The panel defined in claim 2 wherein said first electrodes are provided in pairs and are supported parallel to each other on said base plate and are coated with a layer of insulating material, and said second electrodes are disposed on said insulating layer parallel to each other and transverse to said first electrodes, said second electrodes having tabs which are disposed between adjacent pairs of first electrodes, and a layer of insulating material on said third electrodes with apertures exposing portions of said third electrodes which are inoperative relation with said tabs on said second electrodes.

7. The panel defined in claim 6 wherein said tabs are arrayed in rows and columns and said exposed portions of said third electrodes are arrayed in rows and columns, each tab and each associated exposed portion comprising a D.C. cathode glow cell.

8. A display panel comprising a gas-filled envelope made up of a base plate and a face plate hermetically sealed together with a space between them and a gas filling in said space, a plurality of parallel first electrodes on said base plate and coated with a layer of insulating material to insulate from the gas filling in said envelope, a plurality of parallel second electrodes on the surface of said layer of insulating material and disposed transverse to said first electrodes, said second electrodes being in contact with said gas filling, a plurality of parallel third electrodes on said face plate, said third electrodes being parallel to said first electrodes, a layer of insulating material disposed on said third electrodes and having rows and columns of small apertures which expose portions of said third electrodes, the portions of said third electrodes exposed in said apertures being disposed above and operable with portions of said second electrodes to produce cathode glow when D.C. potentials are connected between selected second and third electrodes, said first electrodes including means for applying A.C. sustaining signals thereto for producing visible glow when selected ones of said second and third electrodes glow.

9. The panel defined in claim 8 wherein said first electrodes ar provided in pairs and said second electrodes have tabs which are disposed between adjacent pairs of said first electrodes.

10. The panel defined in claim 8 wherein said first electrodes are provided in pairs and said second electrodes have tabs which are disposed between adjacent pairs of first electrodes, and said exposed portions of said third electrodes are in operative relation with said tabs of said second electrodes.

* * * * *